US006223644B1

(12) United States Patent
Troncoso

(10) Patent No.: US 6,223,644 B1
(45) Date of Patent: May 1, 2001

(54) GUN HAVING A RAPID FIRE TRIGGER ASSEMBLY

(76) Inventor: Vincent Troncoso, 14090-6100 Rd., Montrose, CO (US) 81401

( * ) Notice: Subject to any disclaimer, the term of this patent is extended or adjusted under 35 U.S.C. 154(b) by 0 days.

(21) Appl. No.: 09/389,579

(22) Filed: Sep. 3, 1999

(51) Int. Cl.[7] ..... F41A 19/09

(52) U.S. Cl. ..... 89/136; 89/27.3; 42/69.01

(58) Field of Search ..... 89/27.3, 136, 129.02; 42/69.01

(56) References Cited

U.S. PATENT DOCUMENTS 4,276,808 * 7/1981 York ..... 89/136
4,532,852 * 8/1985 Hance et al. ..... 89/136

FOREIGN PATENT DOCUMENTS

783165 * 7/1985 (FR) ..... 89/27.3

* cited by examiner

*Primary Examiner*—Stephen M. Johnson
(74) *Attorney, Agent, or Firm*—Donald E. Nist

(57) ABSTRACT

The improved gun has a rapid fire trigger assembly. The gun has a main body and a trigger connected thereto and depending therefrom, with the lower portion of the trigger biased into a forward, non-firing position. The improved rapid fire trigger assembly includes a housing having spaced sidewalls and interconnecting front and rear sides and is adapted to be connected to the gun in front of the trigger. A generally circular elongated tube passes transversely through the housing sidewalls and into the central space in the housing. The tube is rotatable relative to the housing and has a central portion within the housing, which central portion has a number of spaced radiating spokes extending outwardly therefrom. The tube also has opposite end portions extending lateral of the housing sidewalls, one of which end portions has a crank with a trigger finger-receiving space therein. The crank is adjacent the external surface of the sidewall. A generally horizontal wall is secured in the housing central space and a slide is disposed on the top of the horizontal wall, with the front of the slide engageable with the spokes and the rear of the slide extending out a slit in the rear wall of the housing for engagement with the trigger of the gun. When the crank is rotated by a gunner's trigger finger, the central portion of the tube rotates, causing alternately rearward movement of the slide to move the trigger into a firing position, which is followed by the trigger, upon firing the gun, moving forward to the non-firing position, pushing the slide forward. Rapid sequential firing of the gun is thus effected by continuing to turn the crank. The assembly housing can be connected to the trigger guard or directly to the gun main body and can extend back around the trigger if there is not trigger guard. A wedge can be provided to wedge the housing in place against the trigger guard.

8 Claims, 2 Drawing Sheets

GUN HAVING A RAPID FIRE TRIGGER ASSEMBLY

BACKGROUND OF THE INVENTION

1. Field of the Invention

The present invention generally relates to shooting sports equipment and more particularly to an improved gun having a novel rapid fire trigger assembly, and to the novel rapid fire trigger assembly for the gun.

2. Prior Art

Various attempts have been made to provide equipment for guns which can improve the rapidity with which the gun can be fired. Most fully automatic weapons are prohibited. Semi-automatic weapons which are not prohibited require that the gun trigger be pulled each time a shot is to be fired. When a gunner tries to pull the trigger rapidly and repeatedly, shooting accuracy decreases because of the anxiety of the gunner, because his concentration is focused on the act of repeatedly rapidly pulling the trigger instead of holding his gun aim and also because pulling or squeezing the trigger, especially when done rapidly and repeatedly, inevitably applies an angled torque to the gun through the trigger and tends to pull the gun drastically off target.

Devices which have attempted to solve the foregoing problems have failed. Moreover, in most instances they not only are expensive and difficult to install on a gun and adjust to fit the needs of the particular gun and gunner, but they tend to be bulky, easily dislodged and also tend to malfunction during shooting the gun over extended periods of time.

Accordingly, there is a need for an improved device which is inexpensive, durable, easy to install and adjust and which is compact and light in weight. Moreover, the device should be capable of permitting the gunner to fire multiple shots from his gun accurately and with a minimum of concentration on the act of firing. The hand bearing the trigger finger should be free to support the gun for an optimal steady aim during the sequential firing of the gun.

SUMMARY OF THE INVENTION

The improved gun of the present invention bearing the improved rapid fire trigger assembly of the present invention satisfies all the foregoing needs. The gun is easy to use and accurate to shoot in a multiple firing mode. The rapid fire trigger assembly is simple, easy to install, durable, easy to adjust and inexpensive. Moreover, it frees the gunner's trigger hand for steadying the gun for improved accuracy during multiple sequential firing of the gun.

The improved gun has a main body with a trigger connected thereto and depending from the underside thereof. The trigger is biased by a spring or the like into a non-firing forward position. The gun has an improved rapid fire assembly mounted on the gun in front of the trigger. If the gun has a trigger guard, the assembly is mounted on the lower horizontal bar of the guard. If the gun has no trigger guard the assembly is mounted directly to the main body of the gun. In that event, the assembly can include a housing which extends around the trigger to protect the gun from accidently firing.

In any event the assembly includes a housing having spaced sidewalls and front and rear walls interconnecting the same and defining therewith a central space. A generally cylindrical tube extends transversely through the sidewalls and into the central space and has a central portion in the central space, which central portion has a plurality of spaced radially extending spokes. The opposite ends of the tube project out of he sidewalls and the tube can be rotated relative to the housing. In this regard one of the tube ends bears a crank for such rotation, the crank having a trigger finger-receiving depression therein. The crank is close to the sidewall for easy access by the gunner while supporting the gun in both hands for a steady aim. The housing also has an about horizontal wall adjacent the central portion of the tube, upon which rests a slide. The slide has a front end engageable by the spokes and an opposite rear end which extends out through a slit in the rear wall of the housing and toward the trigger for firing of the gun.

When the crank is rotated, the spokes engage the slide and force it rearwardly against the trigger so as to move the trigger to the firing position. After each shot the trigger springs forward, driving the slide forward where it engages a spoke as the crank continues to be rotated, so that this sequence is repeated and the gun can thus be rapidly sequentially fired with total accuracy.

The assembly can include a wedge for wedging the housing into place against the lower bar of a trigger guard. Further features of the invention are set forth in the following detailed description and accompanying drawings.

DRAWINGS

DETAILED DESCRIPTION OF THE PREFERRED EMBODIMENTS OF THE PRESENT INVENTION

Figure 1:
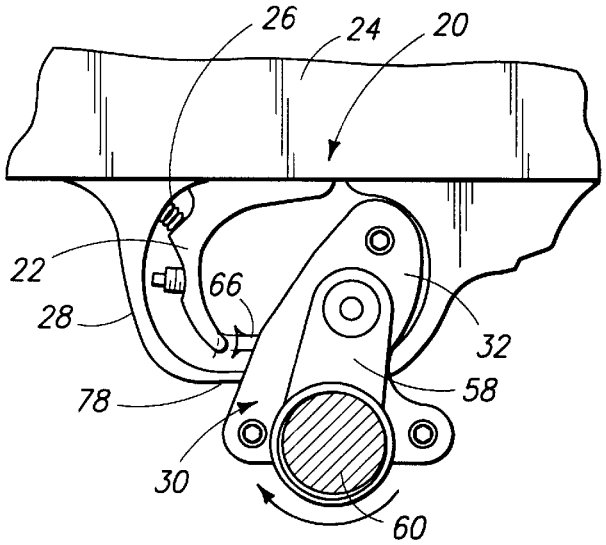
FIG. 1 is a schematic fragmentary side elevation of a first preferred embodiment of the improved gun of the present invention with the improved rapid fire trigger assembly of the present invention installed thereon.
Figure 2:
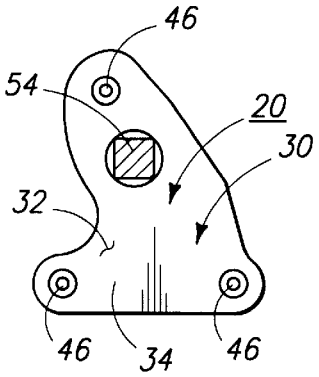
FIG. 2 is a schematic side elevation of one side of the assembly of FIG. 1.

FIGS. 1–8:

Now referring more particularly to FIGS. 1–8, inclusive, of the drawings, a first preferred embodiment of the improved gun of the present invention and the improved rapid fire trigger assembly of the present invention, shown installed thereon, is set forth, Thus, gun 20 is shown which is of conventional design and which includes a depending trigger 22 connected to the main body 24 of gun 20, with trigger 22 depending below main body 24, and with trigger 22 spring biased, as by spring 26 or the like, forwardly in the direction of the associated arrow in FIG. 1 and into the non-firing position of FIG. 1. Gun 20 also includes a generally oval trigger guard 28 connected to the bottom of main body 24 and spaced in front of, below and behind trigger 22.

Figure 8:
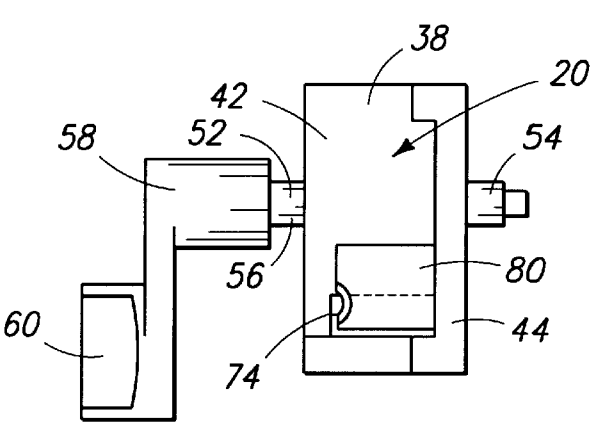
FIG. 8 is a schematic front elevation of the assembly of FIG. 1.
Figure 7:
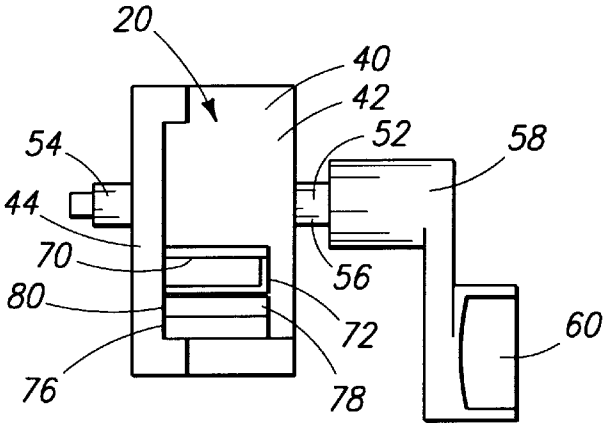
FIG. 7 is a schematic rear elevation of the assembly of FIG. 1.

Gun 20 also includes improved rapid fire trigger assembly 30 comprising housing 32 having spaced sidewalls 34 and 36 interconnected by front wall 38 and rear wall 40 to form a closed container which, however, is split into two parts 42 and 44, as shown in FIGS. 7 and 8, which parts 42 and 44 are releasably held together by screws 46 passing transversely therethrough.

Figure 3:
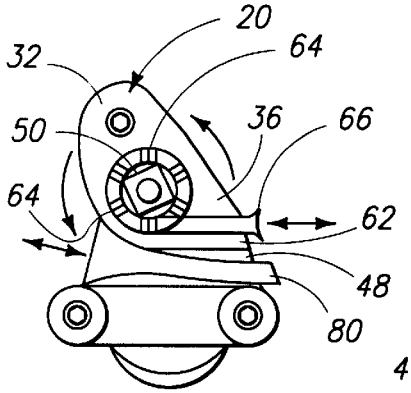
FIG. 3 is a schematic side elevation of the assembly of FIG. 1 with a sidewall removed.

Housing 32 defines a central space 48, in which is disposed the central portion 50 of a generally cylindrical tube 52 which extends transversely through housing 32 and the opposite ends 54 and 56 of which tube 52 extend outwardly from housing 32. End 56 bears a crank 58 having a trigger finger-receiving cup-like depression 60 therein. Tube 52 is journalled for rotation relative to housing 32, as shown by the arrow associated therewith in FIG. 1. Housing 32 includes in central space 48 a generally horizontal shelf or wall 62 adjacent central portion 50 of tube 52, which portion 50 has a plurality of spokes 64 extending radially outwardly from the outer periphery thereof, as shown in FIG. 3. Supported on shelf 62 is a slide 66 which is generally rectangular and flat. The front end 68 of slide 66 is engageable by spokes 64 while the rear end 70 of slide 66 extends out through a slit 72 in rear wall 40 into contact with or close to contact with trigger 22 when the latter is in the resting position shown in FIG. 1. End 70 may be expanded to facilitate that contact.

Housing 32 has aligned slots 74 and 76 therein to releasably receive the about horizontal lower bra 78 of trigger guard 28 and a wedge 80 which aids in holding housing 32 in place within and attached to trigger guard 28. As can be seen, housing 32 is shaped to facilitate this fit.

Figure 4:
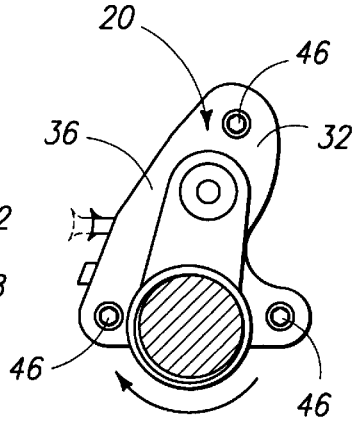
FIG. 4 is a schematic side elevation of the opposite side of the assembly of FIG. 1.
Figure 5:
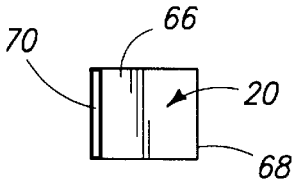
FIG. 5 is a schematic top plan view of the slide of the assembly of FIG. 1.
Figure 6:
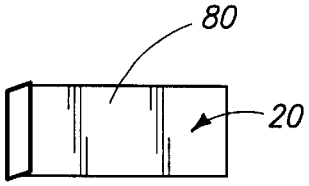
FIG. 6 is a schematic top plan view of the wedge of the assembly of FIG. 1.

As previously explained, when crank 58 is rotated in the direction of the arrow of FIGS. 1 and 4, by the use of the gunner's trigger finger while still holding gun 20 solidly in both hands, spokes 64 drive slide 66 into engagement with trigger 22, forcing it back to fire a shot from gun 20. After the shot trigger 22 springs forward, driving slide 66 forward and into engagement with spokes 64 as crank 58 continues to be turned, thus causing this procedure to continue and another shot to be fired. The rapidity of shooting depends on the speed with which crank 58 is rotated. No torque is applied to trigger 22, so that a steady aim can be maintained by the gunner during the multiple firing of shots from gun 20. Accordingly, assembly 30 imparts to gun 20 improved performance, accuracy and ease of shooting. The components of assembly 30 can be fabricated of any suitable materials, such as metal, plastic or the like or any suitable combination thereof.

Figure 9:
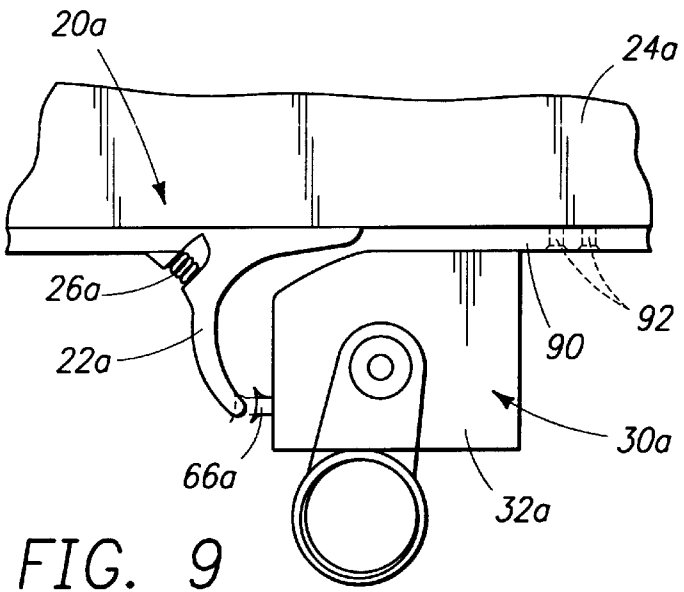
FIG. 9 is a schematic fragmentary side elevation of a second preferred embodiment of the improved gun of the present invention; and, FIG. 10 is a schematic fragmentary side elevation of a third preferred embodiment of the improved gun of the present invention.

FIG. 9:

A second preferred embodiment of the improved gun and assembly of the present invention is schematically depicted in FIG. 9. Thus, gun 20*a* and assembly 30*a* are shown. Components thereof similar to those of gun 20 and assembly 30 bear the same numerals but are succeeded by the letter "a". Gun 20*a* and assembly 30*a* differ from gun 20 and assembly 30 only as follows:

a) Gun 20*a* has no trigger guard; and, housing 32*a* has a top horizontally extending connector plate 90 which connects, as by screws 92, housing 32*a* to the underside of main body 24*a*. Moreover, housing 32*a* has no slots comparable to slots 74 and 76 for receiving the bar of a trigger guard.

Gun 20*a* and assembly 32*a* have the other advantages of gun 20 and assembly 30.

Figure 10:
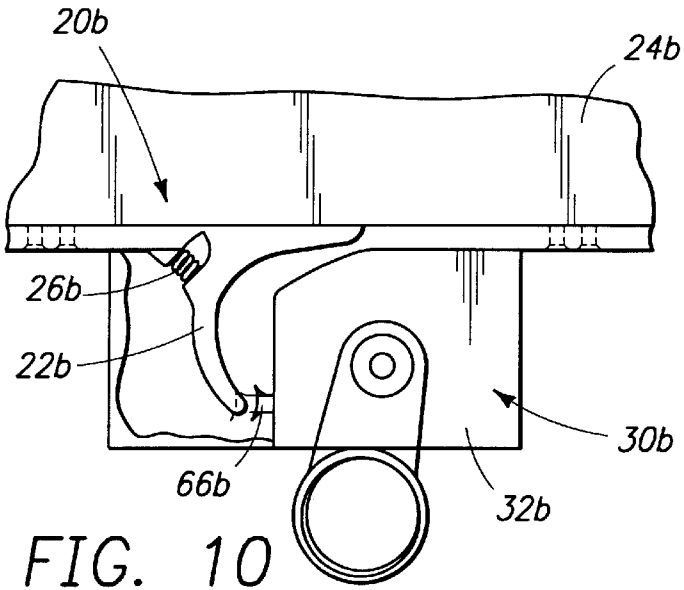

FIG. 10:

A third preferred embodiment of the improved gun and assembly of the present invention is schematically depicted in FIG. 10. Thus gun 20*b* and assembly 30*b* are shown. Components thereof similar to those of assembly 30*a* and gun 20*a* bear the same numerals but are succeeded by the letter "b". Gun 20*b* is substantially identical to gun 20*a* and assembly 30*b* is substantially identical assembly 30*a,* except that housing 32*b* is extended rearwardly to enclose trigger 22*b,* to prevent accidental firing of gun 20*b*. Gun 20*b* and assembly 30*b* have the other advantages of gun 20 and assembly 30*a*.

Various other changes, modifications, alterations and additions can be made in the improved gun and assembly of the present invention, their components and parameters. All such changes, modifications, alterations and additions as are within the scope of the appended claims form part of the present invention.

What is claimed is:

1. An improved gun having a rapid fire trigger assembly, said gun including, in combination:

a) a main body having a firing mechanism disposed therein and a trigger rotatably secured in said main body for operating said firing mechanism, said trigger having a lower portion depending below said main body for operation by a gunner's trigger finger, said lower portion of said trigger being biased into a forward non-firing position, but moveable into a rearward firing position; and, b) a detachable and adjustable rapid fire assembly for said trigger connected to said main body in front of and adjacent to said trigger and comprising, in combination:

i. a closed openable housing having spaced sidewalls interconnected by front and rear walls defining a central space within said housing;

ii. a generally circular elongated tube passing transversely through said sidewalls and into said central space for rotation of said tube relative to said housing, said tube having a central portion within said housing and opposite end portions extending outwardly of said sidewalls, one of said end portions having a crank with a trigger finger-receiving pocket defined therein spaced outwardly of but adjacent to one of said sidewalls, said central portion having a plurality of spaced radiating spokes extending outwardly thereof;

iii. a generally horizontal wall secured within said housing in said central space below but adjacent to said tube central portion; and, iiii. a slide disposed on the top of said horizontal wall, said slide having a front end adapted to releasably engage said spokes and an opposite rear end extending rearwardly of said rear wall and adapted to releasably engage said trigger, whereby rotation of said crank by a gunner's trigger finger rotates said central portion of said tube, effecting alternate rearward movement of said slide for rearward movement of said trigger into said firing position by engagement of said end of said slide with said spokes and alternate forward movement of said slide by said trigger after said firing, to provide rapid sequential firing of said gun.

2. The improved gun of claim 1 wherein said gun includes a trigger guard connected to the underside of said main body, depending therefrom and surrounding said trigger, and wherein said housing defines aligned trigger guard-receiving slots in said front and lower walls for releasably holding said housing in place in front of said trigger.

3. The improved gun of claim 2 wherein said assembly includes a removeable wedge insertable in said trigger guard receiving slots to wedge said housing against said trigger guard.

4. The improved gun of claim 1 wherein said housing extends rearwardly to surround said trigger to prevent accidental firing of said gun.

5. An improved rapid fire trigger assembly for a gun having a main body and a trigger connected thereto and depending therefrom and biased into a forward non-firing position, said assembly comprising, in combination:

i. a housing having spaced sidewalls interconnected by front and rear walls defining a central space within said housing;

ii. a generally circular elongated tube passing transversely through said sidewalls and into said central space for rotation of said tube relative to said housing, said tube having a central portion within said housing and opposite end portions extending outwardly of said sidewalls, one of said end portions having a crank with a trigger finger-receiving pocket defined therein spaced outwardly of but adjacent to one of said sidewalls, said central portion having a plurality of spaced radiating spokes extending outwardly thereof;

iii. a generally horizontal wall secured within said housing in said central space below but adjacent to said tube central portion; and, iiii. a slide disposed on top of said horizontal wall, said slide having a front end adapted to releasably engage said spokes and an opposite rear end extending rearwardly of said rear wall through a slit in said rear wall and adapted to releasably engage said trigger, whereby rotation of said crank by a gunner's finger rotates said central portion of said tube, effecting alternate rearward movement of said slide by said spokes for rearward movement of said trigger into a firing position and alternate forward movement of said slide by said trigger after said firing, to provide rapid sequential firing of said gun.

6. The improved assembly of claim 5 wherein said housing defines aligned slots in said front and rear walls adapted to receive the gun trigger guard to hold said housing in place adjacent said trigger.

7. The improved assembly of claim 6 wherein said assembly includes a removable wedge insertable in said trigger guard-receiving slots to wedge said housing against said trigger guard.

8. The improved assembly of claim 5 wherein said housing extends rearwardly for enclosing said trigger to prevent accidental firing of said gun.

* * * * *